US011969011B2

(12) United States Patent
Hwang et al.

(10) Patent No.: US 11,969,011 B2
(45) Date of Patent: Apr. 30, 2024

(54) CIGARETTE AND AEROSOL GENERATION DEVICE FOR CIGARETTE

(71) Applicant: KT&G CORPORATION, Daejeon (KR)

(72) Inventors: Jung Seop Hwang, Daejeon (KR); Dong Kyun Ko, Sejong (KR); Jae Sung Noh, Cheonan-si (KR); Bong Su Cheong, Daejeon (KR); Sang Won Choi, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 931 days.

(21) Appl. No.: 16/969,778

(22) PCT Filed: Nov. 13, 2019

(86) PCT No.: PCT/KR2019/015426
§ 371 (c)(1),
(2) Date: Aug. 13, 2020

(87) PCT Pub. No.: WO2020/105944
PCT Pub. Date: May 28, 2020

(65) Prior Publication Data

US 2021/0000180 A1 Jan. 7, 2021

(30) Foreign Application Priority Data

Nov. 23, 2018 (KR) ..... 10-2018-0146422

(51) Int. Cl.
*A24F 40/46* (2020.01)
*A24D 1/02* (2006.01)
*A24D 3/08* (2006.01)

(52) U.S. Cl.
CPC ..... *A24F 40/46* (2020.01); *A24D 1/027* (2013.01); *A24D 3/08* (2013.01)

(58) Field of Classification Search
CPC ..... A24D 1/027; A24D 1/20; A24F 40/40; A24F 40/46
See application file for complete search history.

(56) References Cited

U.S. PATENT DOCUMENTS 4,174,719 A * 11/1979 Martin ..... A24D 3/043 131/336
5,271,419 A 12/1993 Arzonico et al.
(Continued)

FOREIGN PATENT DOCUMENTS

CA 3047236 A1 6/2018
CN 103987286 A 8/2014
(Continued)

OTHER PUBLICATIONS

Notification of Reason for Refusal dated Aug. 26, 2021 from the Korean Intellectual Property Office in KR Application No. 10-2018-0146422.

(Continued)

*Primary Examiner* — Oscar C Jimenez
(74) *Attorney, Agent, or Firm* — Sughrue Mion, PLLC

(57) ABSTRACT

A cigarette includes a tobacco rod, a front end plug positioned at a front end of the tobacco rod, a filter rod positioned at a rear end of the tobacco rod, and a wrapper surrounding the tobacco rod, the front end plug, and the filter rod and including at least one perforation formed in an area of the wrapper to allow air to flow to the inside of the wrapper.

10 Claims, 8 Drawing Sheets

(56) References Cited

U.S. PATENT DOCUMENTS

| | | | | |
|---|---|---|---|---|
| 5,666,978 | A | 9/1997 | Counts et al. | |
| 6,367,481 | B1 * | 4/2002 | Nichols | A24D 1/00 131/350 |
| 6,615,840 | B1 | 9/2003 | Fournier et al. | |
| 10,617,149 | B2 | 4/2020 | Malgat et al. | |
| 10,888,120 | B2 | 1/2021 | Zuber | |
| 10,912,336 | B2 | 2/2021 | Reevell | |
| 11,039,642 | B2 | 6/2021 | Zuber et al. | |
| 11,090,450 | B2 | 8/2021 | Li et al. | |
| 11,096,415 | B2 | 8/2021 | Thorens | |
| 11,589,612 | B2 * | 2/2023 | Jung | A24F 40/46 |
| 2004/0020500 | A1 * | 2/2004 | Wrenn | A24C 5/606 131/194 |
| 2007/0215168 | A1 * | 9/2007 | Banerjee | A24D 1/22 131/335 |
| 2008/0173320 | A1 * | 7/2008 | Dunlap | A24D 1/02 131/365 |
| 2010/0200006 | A1 | 8/2010 | Robinson et al. | |
| 2014/0345634 | A1 | 11/2014 | Zuber et al. | |
| 2015/0181929 | A1 | 7/2015 | Lisan et al. | |
| 2016/0150827 | A1 | 6/2016 | Liu | |
| 2019/0014813 | A1 * | 1/2019 | Carraro | A24D 1/025 |
| 2021/0106051 | A1 | 4/2021 | Han et al. | |

FOREIGN PATENT DOCUMENTS

| | | | |
|---|---|---|---|
| CN | 104768405 | A | 7/2015 |
| CN | 105722415 | A | 6/2016 |
| CN | 105996119 | A | 10/2016 |
| CN | 107713005 | A | 2/2018 |
| CN | 108024580 | A | 5/2018 |
| CN | 108041680 | A | 5/2018 |
| CN | 108113051 | A | 6/2018 |
| CN | 108185517 | A | 6/2018 |
| CN | 207544346 | U | 6/2018 |
| CN | 108348709 | A | 7/2018 |
| EP | 3273808 | A1 | 1/2018 |
| EP | 3 494 809 | B1 | 2/2021 |
| JP | 5-211861 | A | 8/1993 |
| JP | 06-327458 | A | 11/1994 |
| JP | 2015-503337 | A | 2/2015 |
| JP | 2016-538848 | A | 12/2016 |
| KR | 2003-0093631 | A | 12/2003 |
| KR | 10-2004-0084899 | A | 10/2004 |
| KR | 10-0831535 | B1 | 5/2008 |
| KR | 10-2014-0119063 | A | 10/2014 |
| KR | 10-2015-0038392 | A | 4/2015 |
| KR | 10-2018-0020136 | A | 2/2018 |
| KR | 10-2018-0070515 | A1 | 6/2018 |
| KR | 10-2018-0111460 | A | 10/2018 |
| WO | 01/070054 | A1 | 9/2001 |
| WO | 2014/020055 | A1 | 2/2014 |
| WO | 2016/156223 | A1 | 10/2016 |
| WO | 2016/207192 | A1 | 12/2016 |
| WO | 2017/198837 | A1 | 11/2017 |
| WO | 2017/207585 | A1 | 12/2017 |
| WO | 2018/182322 | A1 | 10/2018 |

OTHER PUBLICATIONS

Office Action dated Nov. 1, 2021 from the China National Intellectual Property Administration in CN Patent Application No. 201980014952.X.

Extended European Search Report dated Dec. 22, 2021 from the European Patent Office in EP Patent Application No. 19887071.9.

Office Action dated Sep. 19, 2022 from The State Intellectual Property Office of People's Republic of China in Application No. 201980014952.X.

Office Action dated Oct. 11, 2022 from the Japan Patent Office in Application No. 2020-545356.

Yelgior, Tobacco Industry Handbook, China Light Industry Press, Apr. 30, 1999, p. 540, 3 pages total.

International Search Report for PCT/KR2019/015426 dated Feb. 20, 2020 [PCT/ISA/210].

Written Opinion for PCT/KR2019/015426 dated Feb. 20, 2020 [PCT/ISA/237].

Communication dated May 11, 2022 from the Chinese Patent Office in Chinese Application No. 201980014952.X.

Communication dated Jun. 28, 2022 from the Japanese Patent Office in Japanese Application No. 2020-545356.

* cited by examiner

CIGARETTE AND AEROSOL GENERATION DEVICE FOR CIGARETTE

TECHNICAL FIELD

One or more embodiments of the present disclosure relate to a cigarette and an aerosol generating device for the cigarette, and more particularly, to a cigarette including perforations to allow air to flow to the inside and an aerosol generating device for the cigarette.

BACKGROUND ART

Recently, the demand for alternative methods to overcome the shortcomings of traditional cigarettes has increased. For example, there is growing demand for a method of generating aerosol by heating an aerosol generating material in cigarettes, rather than by combusting cigarettes. Accordingly, studies on a heating-type cigarette and a heating-type aerosol generating device have been actively conducted.

DESCRIPTION OF EMBODIMENTS

Technical Problem

An aspect of the present disclosure provides a cigarette including a plug at its front end and perforations formed in its wrapper, and an aerosol generating device for the cigarette.

Solution to Problem

According to an aspect of the present disclosure, a cigarette includes: a tobacco rod; a front end plug positioned at a front end of the tobacco rod; a filter rod positioned at a rear end of the tobacco rod; and a wrapper that surrounds the tobacco rod, the front end plug, and the filter rod, and includes at least one perforation formed in an area of the wrapper to introduce external air.

At least one perforation may reduce draw resistance that is increased by the front end plug.

The wrapper includes an inner wrapper and an outer wrapper that surrounds the inner wrapper, at least one perforation is formed in the outer wrapper, and the inner wrapper may be made of a porous material.

At least one perforation may be arranged along a circumferential direction of the wrapper.

At least one perforation may be formed in an area of the wrapper surrounding the tobacco rod.

At least one perforation may be formed in an area of the wrapper surrounding the filter rod.

The filter rod includes a hollow through which air may flow, and an inner diameter of the filter rod may be 2.0 mm to 4.5 mm.

The filter rod may be made of a polylactide (PLA) material.

At least one perforation may be formed 15 mm to 22 mm away from a rear end of the filter rod in the forward direction in the wrapper.

One portion of the cigarette is inserted into an aerosol generating device including a heater for heating the tobacco rod, and the at least one perforation is arranged in another portion of the cigarette.

The filter rod may include a first segment for cooling an aerosol and a second segment adjacent to a rear end of the first segment to filter a certain composition in the aerosol.

The filter rod may include a flavoring therein.

According to another aspect of the present disclosure, an aerosol generating device includes: a heater configured to heat a cigarette including a tobacco rod, a filter rod, a front end plug positioned at a front end of the tobacco rod, and a wrapper including at least one perforation through which external air may be introduced; a vaporizer configured to generate an aerosol by vaporizing a liquid composition and deliver the aerosol into the cigarette through the front end plug; and a controller configured to control the heater and the vaporizer.

Advantageous Effects of Disclosure

According to an embodiment of the present disclosure, a cigarette may provide adequate draw resistance when smoking by including a plug at its front end and perforations formed in a wrapper.

According to an embodiment of the present disclosure, a cigarette may cool a main stream of vapor to a safe temperature by including a cooling element and perforations formed in a wrapper surrounding the cooling element.

BEST MODE

Figure 1:
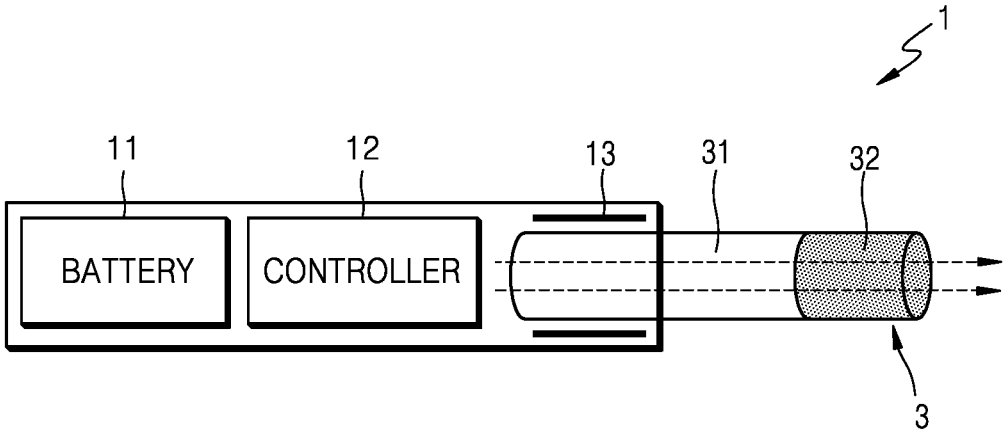
FIGS. 1 through 3 are diagrams showing examples in which a cigarette is inserted into an aerosol generating device.

According to an aspect of the present disclosure, a cigarette includes: a tobacco rod; a front end plug adjacent to a front end of the tobacco rod; a filter rod adjacent to a rear end of the tobacco rod; and a wrapper surrounding the tobacco rod, the front end plug, and the filter rod and including at least one perforation formed in an area of the wrapper to allow air to flow to the inside.

According to another aspect of the present disclosure, an aerosol generating device includes: a heater for heating a cigarette including a tobacco rod, a filter rod, a front end plug adjacent to a front end of the tobacco rod, and a wrapper including perforations to allow air to flow to the inside; a vaporizer for vaporizing a liquid composition to generate an aerosol and delivering the aerosol into the cigarette through the front end plug; and a controller for controlling operation of the heater and the vaporizer.

MODE OF DISCLOSURE

With respect to the terms used to describe the various embodiments, general terms which are currently and widely used are selected in consideration of functions of structural elements in the various embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Throughout the specification, an "aerosol generating article" may refer to a material capable of generating an aerosol, such as a cigarette (tobacco), a cigar, and the like. The aerosol generating article may include an aerosol generating material or an aerosol forming substrate. The aerosol generating article may include solid substances based on tobacco raw materials, such as platy leaf tobacco, cut filter, reconstituted tobacco, and the like. The aerosol may include volatile compounds.

Throughout the specification, "upstream" or "forward" refers to a direction away from the mouth of a user smoking the aerosol generating article and "downstream" or "rear" refers to a direction closer to the mouth of the user smoking the aerosol generating article.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the embodiments set forth herein.

Hereinafter, embodiments of the present disclosure will be described in detail with reference to the drawings.

Figure 2:
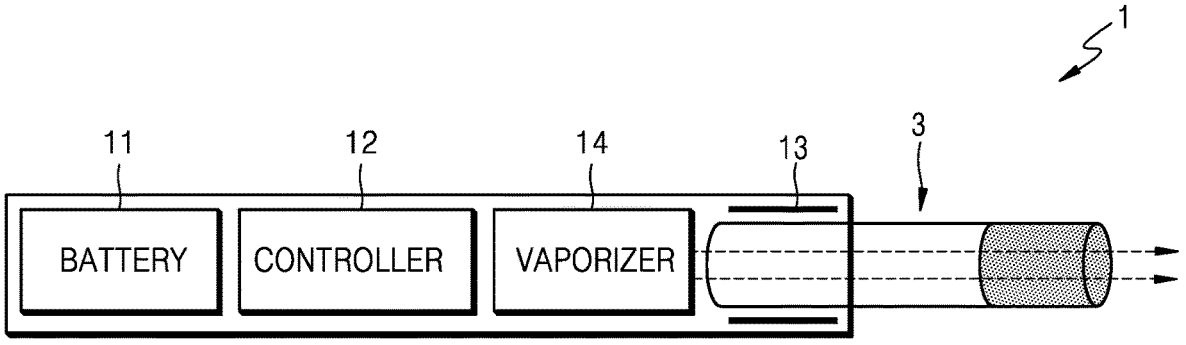
Figure 3:
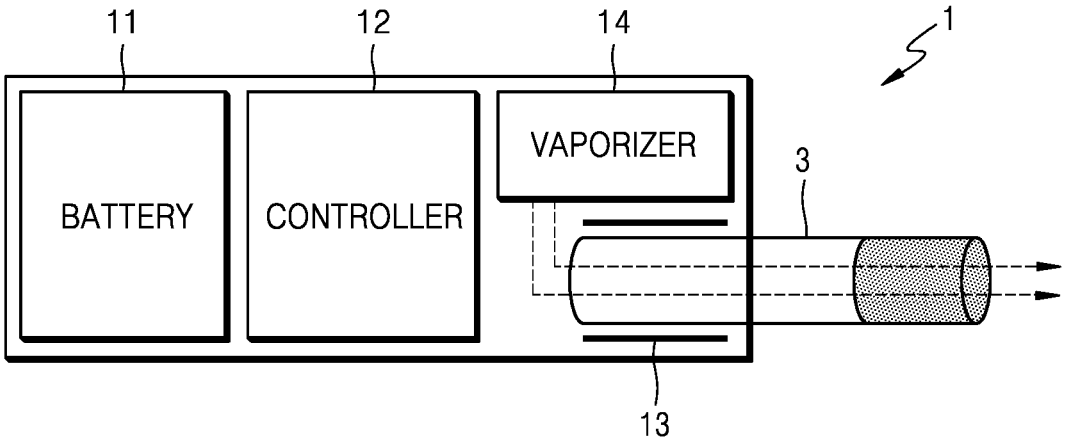

FIGS. 1 through 3 are diagrams showing examples in which a cigarette is inserted into an aerosol generating device.

Referring to FIG. 1, the aerosol generating device 1 may include a battery 11, a controller 12, and a heater 13. Referring to FIGS. 2 and 3, the aerosol generating device 1 may further include a vaporizer 14. Also, the cigarette 3 may be inserted into an inner space of the aerosol generating device 1.

FIGS. 1 through 3 illustrate components of the aerosol generating device 1, which are related to the present embodiment. Therefore, it will be understood by one of ordinary skill in the art related to the present embodiment that other general-purpose components may be further included in the aerosol generating device 1, in addition to the components illustrated in FIGS. 1 through 3.

Also, FIGS. 2 and 3 illustrate that the aerosol generating device 1 includes the heater 13. However, as necessary, the heater 13 may be omitted.

FIG. 1 illustrates that the battery 11, the controller 12, and the heater 13 are arranged in series. Also, FIG. 2 illustrates that the battery 11, the controller 12, the vaporizer 14, and the heater 13 are arranged in series. Also, FIG. 3 illustrates that the vaporizer 14 and the heater 13 are arranged in parallel. However, the internal structure of the aerosol generating device 1 is not limited to the structures illustrated in FIGS. 1 through 3. In other words, according to the design of the aerosol generating device 1, the battery 11, the controller 12, the heater 13, and the vaporizer 14 may be differently arranged.

When the cigarette 3 is inserted into the aerosol generating device 1, the aerosol generating device 1 may operate the heater 13 and/or the vaporizer 14 to generate an aerosol. The aerosol generated by the heater 13 and/or the vaporizer 14 is delivered to a user by passing through the cigarette 3.

As necessary, even when the cigarette 3 is not inserted into the aerosol generating device 1, the aerosol generating device 1 may heat the heater 13.

The battery 11 may supply power to be used for the aerosol generating device 1 to operate. For example, the battery 11 may supply power to heat the heater 13 or the vaporizer 14, and may supply power for operating the controller 12. Also, the battery 11 may supply power for operations of a display, a sensor, a motor, etc. mounted in the aerosol generating device 1.

The controller 12 may control overall operations of the aerosol generating device 1. In detail, the controller 12 may control not only operations of the battery 11, the heater 13, and the vaporizer 14, but also operations of other components included in the aerosol generating device 1. Also, the controller 12 may check a state of each of the components of the aerosol generating device 1 to determine whether or not the aerosol generating device 1 is able to operate.

The controller 12 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The heater 13 may be heated by the power supplied from the battery 11. For example, when the cigarette 3 is inserted into the aerosol generating device 1, the heater 13 may be located outside the cigarette 3. Thus, the heated heater 13 may increase a temperature of an aerosol generating material in the cigarette 3.

The heater 13 may include an electro-resistive heater. For example, the heater 13 may include an electrically conductive track, and the heater 13 may be heated when currents flow through the electrically conductive track. However, the heater 13 is not limited to the example described above and may include all heaters which may be heated to a desired temperature. Here, the desired temperature may be pre-set in the aerosol generating device 1 or may be set as a temperature desired by a user.

As another example, the heater 13 may include an induction heater. In detail, the heater 13 may include an electrically conductive coil for heating a cigarette 3 in an induction heating method, and the cigarette 3 may include a susceptor which may be heated by the induction heater.

For example, the heater 13 may include a tube-type heating element, a plate-type heating element, a needle-type heating element, or a rod-type heating element, and may heat the inside or the outside of the cigarette 3, according to the shape of the heating element.

Also, the aerosol generating device 1 may include a plurality of heaters 13. Here, the plurality of heaters 13 may be inserted into the cigarette 3 or may be arranged outside the cigarette 3. Also, some of the plurality of heaters 13 may be inserted into the cigarette 3 and the others may be arranged outside the cigarette 3. In addition, the shape of the heater 13 is not limited to the shapes illustrated in FIGS. 1 through 3 and may include various shapes.

The vaporizer 14 may generate an aerosol by heating a liquid composition and the generated aerosol may pass through the cigarette 3 to be delivered to a user. In other words, the aerosol generated via the vaporizer 14 may move along an air flow passage of the aerosol generating device 1 and the air flow passage may be configured such that the aerosol generated via the vaporizer 14 passes through the cigarette 3 to be delivered to the user. The vaporizer 14 may heat the liquid composition to generate the aerosol and may release the aerosol toward a cigarette for the aerosol to pass through the cigarette inserted into a cigarette insertion portion.

For example, the vaporizer 14 may include a liquid storage, a liquid delivery element, and a heating element, but it is not limited thereto. For example, the liquid storage, the liquid delivery element, and the heating element may be included in the aerosol generating device 1 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 14 or may be formed integrally with the vaporizer 14.

For example, the liquid composition may include water, a solvent, ethanol, plant extract, spices, flavorings, or a vitamin mixture. The spices may include menthol, peppermint, spearmint oil, and various fruit-flavored ingredients, but are not limited thereto. The flavorings may include ingredients capable of providing various flavors or tastes to a user. Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element. The heating element may be heated by a current supply and may transfer heat to the liquid composition in contact with the heating element, thereby heating the liquid composition. As a result, aerosol may be generated.

For example, the vaporizer 14 may be referred to as a cartomizer or an atomizer, but it is not limited thereto.

The aerosol generating device 1 may further include general-purpose components in addition to the battery 11, the controller 12, the heater 13, and the vaporizer 14. For example, the aerosol generating device 1 may include a display capable of outputting visual information and/or a motor for outputting haptic information. Also, the aerosol generating device 1 may include at least one sensor (a puff detecting sensor, a temperature detecting sensor, a cigarette insertion detecting sensor, etc.). Also, the aerosol generating device 1 may be formed as a structure where, even when the cigarette 3 is inserted into the aerosol generating device 1, external air may be introduced or internal air may be discharged.

Although not illustrated in FIGS. 1 through 3, the aerosol generating device 1 and an additional cradle may form together a system. For example, the cradle may be used to charge the battery 11 of the aerosol generating device 1. Alternatively, the heater 13 may be heated while the cradle and the aerosol generating device 1 are coupled to each other.

The cigarette 3 may be similar as a general combustive cigarette. For example, the cigarette 3 may be divided into a tobacco rod 31 including an aerosol generating material and a filter rod 32 including a filter, etc. The filter rod 32 of the cigarette 3 may also include an aerosol generating material. For example, an aerosol generating material made in the form of granules or capsules may be inserted into the second portion.

The entire tobacco rod 31 may be inserted into the aerosol generating device 1, and the filter rod 32 may be exposed to the outside. Alternatively, only a portion of the tobacco rod may be inserted into the aerosol generating device 1, or the entire tobacco rod 31 and a portion of the filter rod 32 may be inserted into the aerosol generating device 1. The user may puff aerosol while holding the filter rod 32 by the mouth of the user. In this case, the aerosol is generated by the external air passing through the tobacco rod 31, and the generated aerosol passes through the filter rod 32 and is delivered to the user's mouth.

For example, the external air may flow into at least one air passage formed in the aerosol generating device 1. For example, opening and closing of the air passage and/or a size of the air passage may be adjusted by the user. Accordingly, the amount and quality of vapor may be adjusted by the user. As another example, the external air may flow into the cigarette 3 through at least one hole formed in a surface of the cigarette 3.

Hereinafter, an example of the cigarette will be described with reference to FIG. 4.

Figure 4:
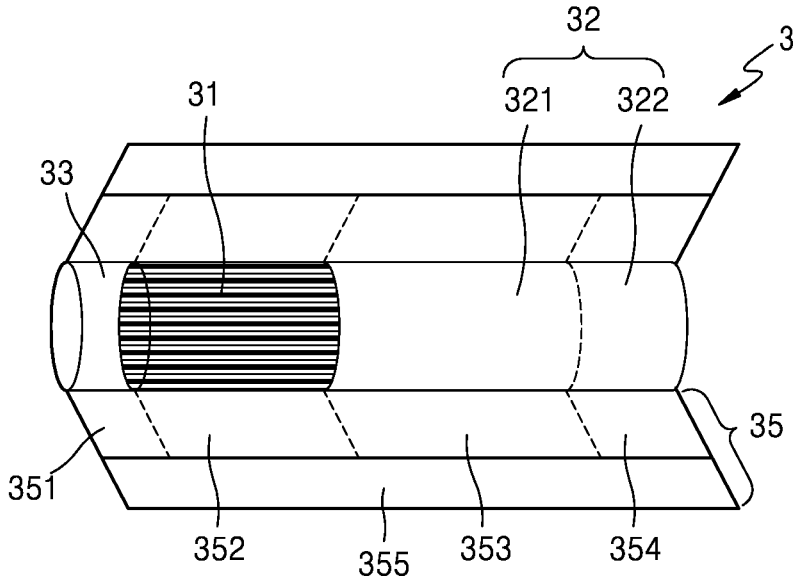
FIG. 4 illustrates an example of the cigarette.

Referring to FIG. 4, the cigarette 3 may include a tobacco rod 31, a filter rod 32 and a front end plug 33. The tobacco rod 31 may include a tobacco material and an aerosol generating material. The tobacco material can be tobacco.

The filter rod 32 may be adjacent to a rear end of the tobacco rod 31. The filter rod 32 may include a single segment or a plurality of segments. For example, the filter rod 32 may include a first segment 321 configured to cool an aerosol and a second segment 322 configured to filter a certain component included in the aerosol.

The front end plug 33 may be arranged on one side of the tobacco rod 31 opposite the filter rod 32. The front end plug 33 may be adjacent to a front end of the tobacco rod 31. The front end plug 33 may prevent the tobacco rod 31 from falling out of the cigarette 3 and prevent the liquefied aerosol from flowing into the aerosol generating device 1 of FIGS. 1 to 3 from the tobacco rod 31 during smoking.

The cigarette 3 may be packaged by at least one wrapper 35. The wrapper 35 may be surrounding the cigarette 3. For example, the front end plug 33 may be packaged by a first wrapper 351, the tobacco rod 31 may be packaged by a second wrapper 352, the first segment 321 may be packaged by a third wrapper 353, and the second segment 322 may be packaged by a fourth wrapper 354. The cigarette 3 may be completely repackaged by a fifth wrapper 355. The fifth wrapper 355 may be an outer wrapper, whereas the first wrapper 351, the second wrapper 352, the third wrapper 353, and the fourth wrapper 354 may be an inner wrapper surrounded by the fifth wrapper 355.

A diameter of the cigarette 3 may be within a range of 5 mm to 9 mm, and a length of the cigarette 3 may be about 48 mm. However, embodiments of the present disclosure are not limited thereto. For example, a length of the front end plug 33 may be about 7 mm, a length of the tobacco rod 31 may be about 15 mm, a length of the first segment 321 may be about 12 mm, and a length of the second segment 322 may be about 14 mm. However, embodiments of the present disclosure are not limited thereto.

The tobacco rod 31 may include, for example, the aerosol generating material at least one of glycerin, propylene glycol, ethylene glycol, dipropylene glycol, diethylene glycol, triethylene glycol, tetraethylene glycol, and oleyl alcohol, but it is not limited thereto. Also, the tobacco rod 31 may include other additives, such as flavors, a wetting agent, and/or organic acid. Also, the tobacco rod 31 may include a flavored liquid, such as menthol or moisturizer, which is injected to the tobacco rod 31.

The tobacco rod 31 may be manufactured in various forms. For example, the tobacco rod 31 may be formed using a sheet or strands. Also, the tobacco rod 31 may be formed as a pipe tobacco, which is formed of tiny bits cut from a tobacco sheet. Also, the tobacco rod 31 may be surrounded by a heat conductive material. For example, the heat-conducting material may be a cellulose acetate filter. Shapes of the filter rod 32 are not limited. For example, the filter rod 32 may include a cylinder-type rod or a tube-type rod having a hollow inside. Also, the filter rod 32 may include a recess-type rod. When the filter rod 32 includes a plurality of segments, at least one of the plurality of segments may have a different shape.

Hereinafter, each segment of the filter rod 32 will be described in detail.

The first segment 321 of the filter rod 32 may cool the aerosol generated by the heater 13 heating the tobacco rod 31. Thus, the user may inhale the aerosol cooled to a suitable temperature.

The length or diameter of the first segment 321 may differ according to a shape of the cigarette 3. For example, the length of the first segment 321 may be suitably employed within a range of 7 mm to 20 mm. It is desirable that the length of the first segment 321 be about 14 mm. However, embodiments of the present disclosure are not limited thereto.

According to an embodiment, the first segment 321 of the filter rod 32 may include a cellulose acetate filter. For example, the first segment 321 may include a tube-shaped structure including a hollow (e.g., 3211 of FIG. 6) therein. When the heater 13 is inserted, the first segment 321 may prevent a material within the tobacco rod 210 from being pushed back. Also, the first segment 321 may generate a cooling effect of the aerosol. A diameter of the hollow included in the first segment 321 may be suitably set within a range of 2 mm to 4.5 mm. However, embodiments of the present disclosure are not limited thereto According to another embodiment, the first segment 321 may be made by weaving a polymer fiber. In that case, a fragrance liquid may be applied to the polymer fiber. Alternatively, the first segment 321 may be made by weaving a separate fiber to which the fragrance liquid is applied together with the polymer fiber. Alternatively, the first segment 321 may be formed by a crimped polymer sheet. Thereby, a surface area in contact with the aerosol may be increased. As a result, the cooling effect of the aerosol by a cooling structure 830 may be further increased.

For example, the polymer may be made of a material selected from a group consisting of polyethylene (PE), polypropylene (PP), polyvinyl chloride (PVC), polyethylene terephthalate (PET), polylactide (PLA), cellulose acetate (CA), aluminum foil.

As the first segment 321 is formed by a woven polymer fiber or a crimped polymer sheet, the first segment 321 may include singular or plural channels extending in a longitudinal direction. The channel, here, refers to a passage through which a gas (for example, air or aerosol) passes.

The first segment 321 may include a thread containing a volatile flavor ingredient. The volatile flavor ingredient may include menthol. However, embodiments of the present disclosure are not limited thereto. The second segment 322 of the filter rod 32 may include a cellulose acetate filter. A length of the second segment 322 may be suitably employed within a range of 4 mm to 20 mm. For example, the length of the second segment 322 may be about 14 mm or about 12 mm. However, embodiments of the present disclosure are not limited thereto.

The second segment 322 may be made of cellulose acetate. The second segment 322 may be made by spraying the fragrance liquid onto the second segment 322 for a flavor to be produced. Alternatively, a separate fiber onto which the fragrance liquid is applied may be inserted into the second segment 322. The aerosol generated from the tobacco rod 31 is cooled while passing through the first segment 321, and the cooled aerosol is delivered to the user through the second segment 322. Therefore, when a flavoring element is added to the second segment 322, the flavor delivered to the user may last for a long time.

The front end plug 33 may be made of cellulose acetate. In addition, if necessary, the front end plug 33 may include at least one channel, and a cross-sectional shape of the channel may be made in various ways.

Hereinafter, the wrapper 35 will be described in detail.

The first wrapper 351 may include metal foil, such as aluminum foil combined with a common filter wrapper. The second wrapper 352 and the third wrapper 353 may be made of common plug wrap paper. For example, the second wrapper 352 and the third wrapper 353 may include a porous wrapper or a non-porous wrapper.

FIG. 5 shows diagrams illustrating a cigarette in which perforations are formed according to an embodiment of the present disclosure.

At least one perforation 36 may be formed in the wrapper 35. External air may flow into the cigarette 3 through the perforations 36 formed in the wrapper 35.

The perforations 36 may be formed at various positions. For example, the perforations 36 may be formed in the fifth wrapper 355. Air flowing in through the fifth wrapper 355 may pass through an inner wrapper surrounded by the fifth wrapper 355 to flow into the cigarette 3.

Figure 5A:
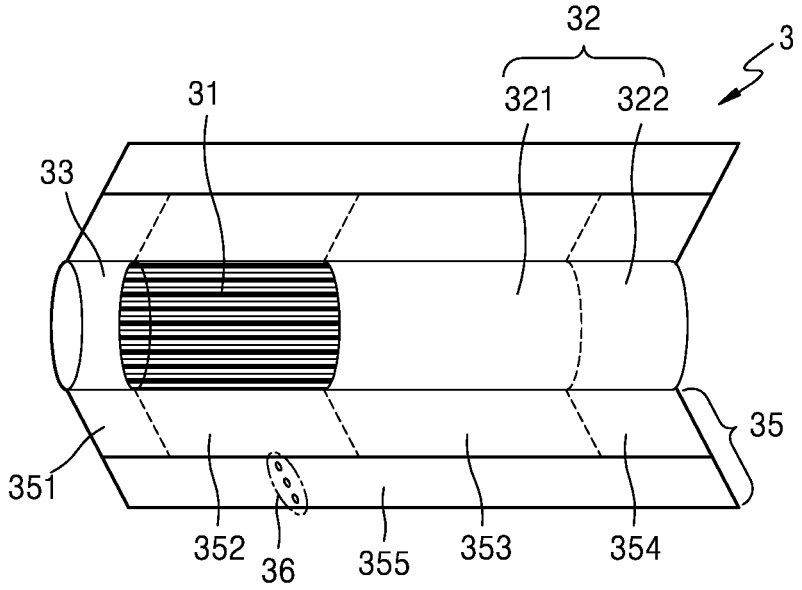
FIG. 5 shows diagrams illustrating a cigarette in which perforations are formed according to an embodiment of the present disclosure.
Figure 5B:
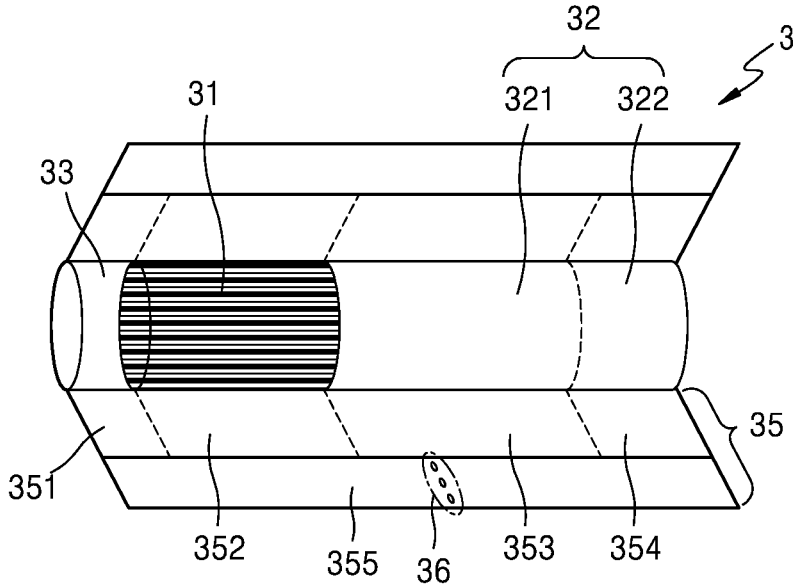

Referring to FIG. 5A, for example, the perforations 36 may be formed in an area of the wrapper 35 surrounding the tobacco rod 31. Referring FIG. 5B, for another example, the perforations 36 may be formed in an area of the wrapper 35 surrounding the filter rod 32. More specifically, the perforations 36 may be formed in an area of the wrapper 35 surrounding the first segment 321. In that case, the air flowing in through the perforations 36 may cool heated air passing through the tobacco rod 31 and a surface of the filter rod 32 before the heated air reaches the mouth of a user.

The perforations 36 may be formed 12 mm to 24 mm away from a rear end of the filter rod 32 in the forward direction. It is desirable that the perforations 36 be formed 15 mm to 22 mm away from a rear end of the filter rod 32 in the forward direction. For example, at least one perforation 36 may be formed about 15 mm, about 20 mm, and/or about 22 mm away from a rear end of the filter rod 32 in the forward direction.

The perforations 36 may be formed along an outer circumferential surface of the wrapper 35, and the perforations 36 may be spaced apart from each other along the outer circumferential surface at regular intervals. A diameter of the perforations 36 may be 0.02 mm to 0.08 mm, for example, 0.05 mm.

Since the perforations 36 are formed along the outer circumferential surface of the wrapper 35, the number of channels for introducing air may increase. In addition, since another perforation 36 is formed opposite one perforation 36, air may easily flow between one perforation 36 and another perforation 36 within the cigarette 3. Thereby, draw resistance may be reduced.

Since air flows in from various directions through the perforations 36 formed along the outer circumferential surface of the wrapper 35, air inflow may be constant in various directions.

Thereby, air circulation within the cigarette 3 may be constant in a circumferential direction of the wrapper 35 due to the air inflow. As a result, a main stream of vapor may be uniformly cooled at each point on an outer periphery of the wrapper 35.

The number of the perforations 36 may vary. For example, three perforations 36 may be formed, or nine perforations 36 may be formed. In that case, the perforations 36 may be spaced apart from each other by a constant distance, or may be spaced apart from each other by a different distance with a constant pattern.

Figure 6:
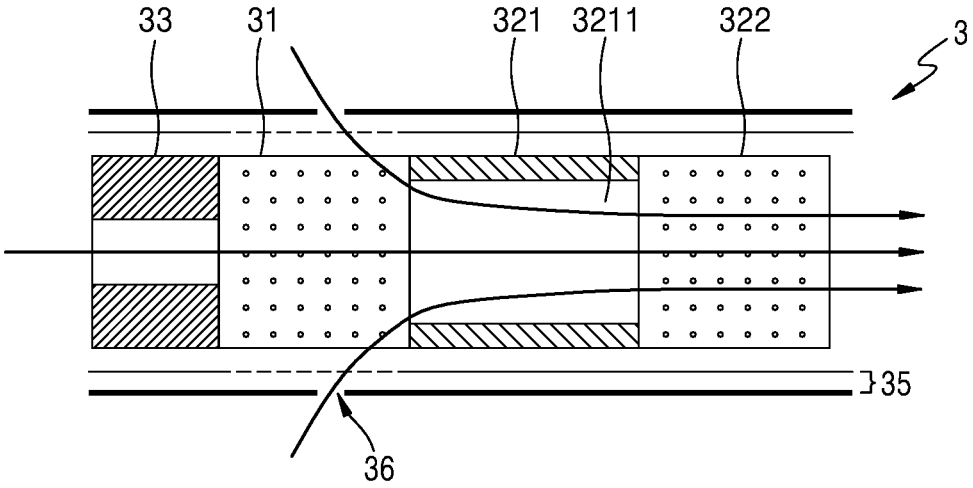
FIG. 6 is a cross-sectional view in a lengthwise direction of a cigarette illustrating the flow of air passing through the cigarette according to an embodiment of the present disclosure.

FIG. 6 is a cross-sectional view in a lengthwise direction of a cigarette illustrating the flow of air passing through the cigarette according to an embodiment of the present disclosure.

Referring to FIG. 6, a front end of the cigarette is provided with a front end plug, and perforations may be formed in a wrapper. For convenience, it has been illustrated that the perforations are formed in one area of the wrapper that faces a first wrapper surrounding the tobacco rod 31. However, the following description may also apply to a case where the perforations are formed in a different area of the wrapper.

When a user smokes the cigarette 3, air flows into the cigarette 3 through the front end plug 33, mixes with aerosol while passing through the tobacco rod 31, passes through the first segment 321 and the second segment 322 of the filter rod 32, and reaches the mouth of the user.

Depending on the degree of draw resistance in the user puffs, the amount of air inhaled in one puff, the time during which air remains in the tobacco rod 31, the time during which the air remains in the first segment 321, the amount of the aerosol contained in the air, and the like may be determined. Thus, the draw resistance is an important factor to be considered when designing the cigarette 3.

In terms of the draw resistance, a front end plug and perforations are complementary to each other. For example, the perforations may be formed to reduce the draw resistance as much as the draw resistance is increased by the front end plug. As another example, the front end plug may be combined to increase the draw resistance as much as the draw resistance is reduced as the perforations are formed.

More specifically, the front end plug 33 arranged at a front end of the cigarette 3 may reduce the inflow of air and increase the draw resistance when smoking by reducing a cross-sectional area through which air flows into the cigarette 3. The draw resistance reduced by the front end plug 33 may vary depending on a shape of the front end plug 33. For example, when the front end plug 33 is a hollow tube, the smaller an inner diameter of the hollow tube, the greater the draw resistance. Also, the greater a length of the front end plug 33, the greater the draw resistance.

Air that has passed through the wrapper 35 through the perforations 36 and then flown into the cigarette 3 during a puff of the user may join the air flowing in through the front end plug 33 within the cigarette 3.

Since the perforations 36 are formed in the wrapper 35, air may flow in through a side surface of the cigarette 3. Therefore, the inflow of air may increase and the draw resistance may be reduced.

Effect derived from the reduction of the draw resistance may vary depending on the number, shape, size, etc. of the perforations 36. For example, the greater the number of the perforations 36, the less the draw resistance. In addition, the greater the size of the perforations 36, the less the draw resistance.

The degree to which the front end plug 33 determined according to a designed value affects the increase in the draw resistance may be relatively larger than the degree to which the perforations 36 affect the decrease in the draw resistance.

Figure 7:
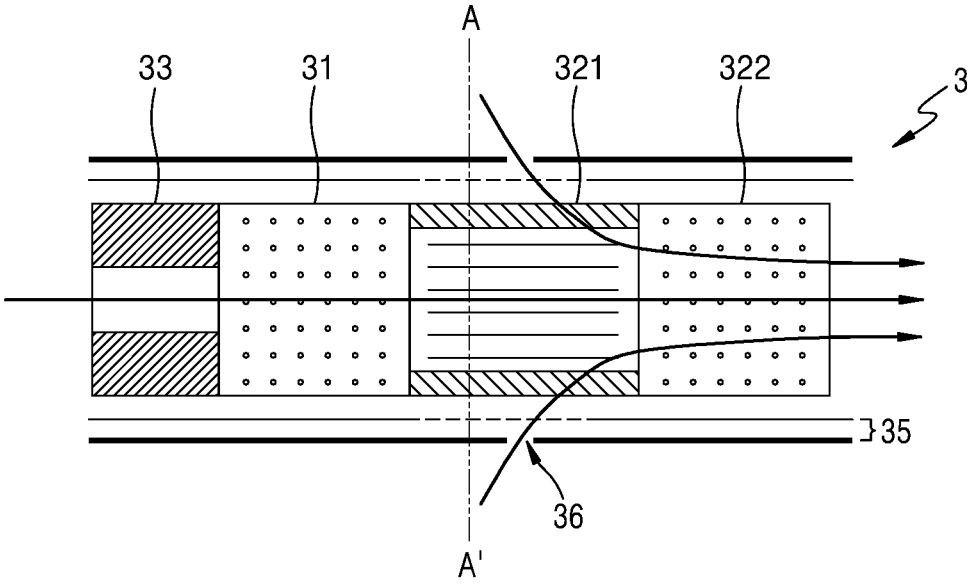
FIG. 7 is a cross-sectional view in a lengthwise direction of a cigarette illustrating the flow of air passing through the cigarette according to another embodiment of the present disclosure.

FIG. 7 is a cross-sectional view illustrating the flow of air passing through a cigarette according to an embodiment of the present disclosure.

Referring to FIG. 7, a front end of the cigarette 3 is provided with the front end plug 33, and the perforations 36 may be formed in one area of the wrapper 35 surrounding the first segment 321. For example, the perforations 36 may be formed in the fifth wrapper 355.

Air may pass through the fifth wrapper 355 and the first wrapper 351 through the perforations 36 to flow into the first segment 321 during a puff. The air flowing in through the perforations 36 may join a main stream of vapor that flows in through the front end plug 33, flows downstream through the tobacco rod 31, at the first segment 321.

Whereas the air flowing in through the perforations 36 comes from outside, the main stream of vapor is heated. Therefore, the air flowing in through the perforations 36 may be cooler than the main stream of vapor. Thus, the main stream of vapor may be cooled. Thereby, the main stream of vapor reaching the mouth of a user and a surface of the filter rod 32 in contact with the user's hand may be cooled to a safe temperature.

When a portion of the cigarette 3 including the tobacco rod 31 is inserted into the aerosol generating device 1, the perforations 36 may be exposed out of the aerosol generating device 1. When a cigarette is inserted into an aerosol generating device, a front end plug, a tobacco rod and a portion of a filter rod may be arranged within the aerosol generating device, and another portion of the filter rod may be exposed out of the aerosol generating device. Perforations may be positioned on the right of the line A-A' representing an extension of an exterior of the aerosol generating device such that the perforations are exposed out of the aerosol generating device. Thereby, external air that has not been heated by a heater may flow in from outside through the perforations 36, and a cooling effect for the main stream of vapor may be improved.

The first segment 321 is a configuration capable of cooling the main stream of vapor, is a tube including a hollow, and may be made of a PLA material as described above. When the first segment 321 is a tube having an inner diameter larger than the inner diameter of the front end plug 33, the main stream of vapor may diffuse in the first segment 321 after passing through the front end plug 33. As directionality of the main stream of vapor decreases while diffusing, a contact area and contact time between the air flowing in from outside through the perforations 36 and the diffused main stream of vapor may increase. Accordingly, the cooling effect of the main stream of vapor may be improved.

Therefore, the main stream of vapor may be cooled not only by the hollow and the PLA material of the first segment 321 while passing through the first segment 321, but also by the air flowing in from outside through the perforations 36, which improves the cooling effect.

As described above with reference to FIG. 6, the draw resistance may also be regulated by the front end plug 33 and the perforations 36 in the case where the perforations 36 are formed in an area of the wrapper surrounding the first segment 321 as shown in FIG. 7.

Figure 8A:
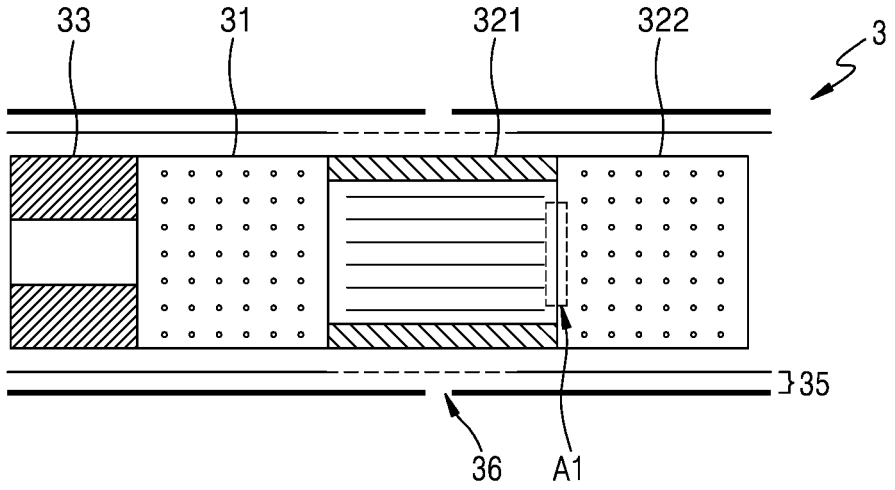
FIG. 8 shows diagrams showing points where a temperature of a main stream of vapor and a surface temperature of a cigarette are measured in the cigarette according to an embodiment of the present disclosure.
Figure 8B:
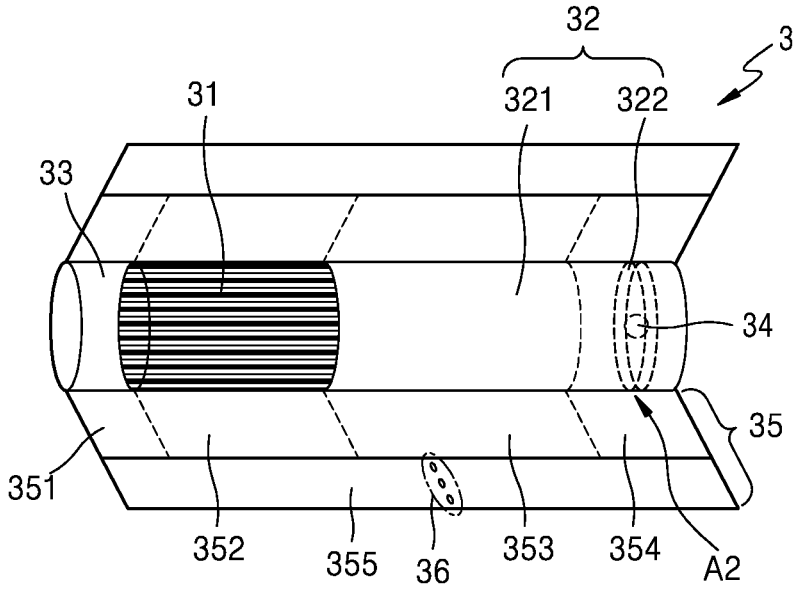

FIG. 8 shows diagrams illustrating portions of a cigarette where a temperature of a main stream of vapor and a surface temperature of a cigarette are measured according to an embodiment of the present disclosure. FIG. 8A is a cross-sectional view in a lengthwise direction of the cigarette, and FIG. 8B is a perspective view of the cigarette. The perforations 36 may be arranged in an area of a wrapper surrounding the first segment 321.

Table 1 is data illustrating the measured temperature of the main stream of vapor and the measured surface temperature of the cigarette 3 to assess a cooling effect of the perforations 36. As shown in FIG. 8A, the first segment 321 and the second segment 322 are adjacent to each other, and the temperature of the main stream of vapor has been measured in an area A1 in which the main stream of vapor passes. As shown in FIG. 8B, the surface temperature of the cigarette 3 has been measured in an area A2 which is a middle portion of a surface of the second segment 322.

Data has been generated for the cases where the first segment 321 is made as a tube including a hollow, where the first segment 321 is made of a PLA material, and where the first segment 321 is made of a PLA material and the perforations 36 are formed in the wrapper 35.

TABLE 1

| | TUBE-SHAPED FILTER | PLA MATERIAL FILTER | PLA MATERIAL FILTER INCLUDING PERFORATIONS |
|---|---|---|---|
| TEMPERATURE (° C.) OF MAIN STREAM OF VAPOR | 55 | 52 | 50 |
| CIGARETTE SURFACE TEMPERATURE (° C.) | 61 | 56 | 52 |

Table 1 shows that the main stream of vapor is cooler when the first segment 321 is a PLA material filter than when the first segment 321 is a tube-shaped filter, and the main stream of vapor is the coolest when the first segment 321 is a PLA material filter including the perforations 36 therein. Such cooling effect similarly applies to a surface of the cigarette 3. The cooling effect of a surface of the cigarette 3 is improved in ascending order of the case where the first segment 321 is a tube-shaped filter, the case where the first segment 321 is a PLA material filter, and the case where the first segment 321 is a PLA material filter including the perforations 36 therein. Thus, the perforations 36 formed in the wrapper 35 surrounding the first segment 321 improve the cooling effect of the main stream of vapor and of the surface of the cigarette 3.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is defined by the appended claims rather than by the foregoing description, and all differences within the scope of equivalents thereof should be construed as being included in the present disclosure.

What is claimed is:

1. A cigarette comprising:

a tobacco rod;

a front end plug positioned at a front end of the tobacco rod;

a filter rod positioned at a rear end of the tobacco rod;

a first wrapper that surrounds the filter rod; and a second wrapper that surrounds the first wrapper, the tobacco rod, the front end plug, and the filter rod, wherein the second wrapper includes at least one perforation formed in an area of the second wrapper that surrounds the first wrapper such that external air is introduced at the filter rod, and wherein, when the cigarette is inserted into an aerosol generating device, the front end plug, the tobacco rod and a first portion of the filter rod are arranged within the aerosol generating device, and a second portion of the filter rod is exposed outside of the aerosol generating device.

2. The cigarette of claim 1, wherein the at least one perforation reduces draw resistance that is increased by the front end plug.

3. The cigarette of claim 1, wherein the first wrapper is made of a porous material.

4. The cigarette of claim 1, wherein the at least one perforation is arranged along a circumferential direction of the second wrapper.

5. The cigarette of claim 1, wherein the area of the second wrapper in which the at least one perforation is formed surrounds the filter rod.

6. The cigarette of claim 1, wherein the filter rod includes a hollow through which air may flow, and an inner diameter of the hollow is 2.0 mm to 4.5 mm.

7. The cigarette of claim 1, wherein the filter rod is made of a polylactide (PLA) material.

8. The cigarette of claim 1, wherein the at least one perforation is 15 mm to 22 mm away from the rear end of the filter rod in a forward direction in the second wrapper.

9. The cigarette of claim 1, wherein one portion of the cigarette is inserted into the aerosol generating device including a heater for heating the tobacco rod, and the at least one perforation is arranged in another portion of the cigarette.

10. An aerosol generating device comprising:

a heater configured to heat a cigarette including a tobacco rod, a filter rod positioned at a rear end of the tobacco rod, a front end plug positioned at a front end of the tobacco rod, a first wrapper that surrounds the filter rod, and a second wrapper including at least one perforation formed in an area of the second wrapper that surrounds the first wrapper such that external air is introduced at the filter rod;

a vaporizer configured to generate an aerosol by vaporizing a liquid composition and deliver the aerosol into the cigarette through the front end plug; and a controller configured to control the heater and the vaporizer, wherein, when the cigarette is inserted into the aerosol generating device, the front end plug, the tobacco rod and a first portion of the filter rod are arranged within the aerosol generating device, and a second portion of the filter rod is exposed outside of the aerosol generating device.

* * * * *